United States Patent [19]

Bross

[11] 4,276,709

[45] Jul. 7, 1981

[54] HANDGUN STOCK POMMEL

[76] Inventor: Robert Bross, Ballville Rd., Bolton, Mass. 01740

[21] Appl. No.: 94,002

[22] Filed: Nov. 14, 1979

[51] Int. Cl.[3] ..... F41C 23/00

[52] U.S. Cl. ..... 42/71 P

[58] Field of Search ..... 42/71 P, 71 R, 59, 85, 42/1 R

[56] References Cited

U.S. PATENT DOCUMENTS

| | | | |
|---|---|---|---|
| 102,782 | 5/1870 | Dedartein | 42/59 |
| 1,228,506 | 6/1917 | Wesson | 42/71 P |
| 1,848,682 | 3/1932 | Wesson | 42/71 P |
| 2,292,351 | 8/1942 | Carpenter et al. | 42/71 R |
| 2,308,627 | 1/1943 | Rickenbacher | 42/71 P |
| 3,384,988 | 5/1968 | Salaiz | 42/71 P |
| 3,852,904 | 12/1974 | Drevet | 42/71 R |

OTHER PUBLICATIONS

Stoeger Arms Corporation, 1949 Catalog, p. 418.

*Primary Examiner*—Charles T. Jordan

*Attorney, Agent, or Firm*—Hamilton, Brook, Smith and Reynolds

[57] ABSTRACT

A unique pommel or butt plate for handgun stocks is described. The pommel comprises a pommel plate (32) having a mounting boss (34) extending from the inner surface of plate (32) and a mounting pin (36) extending from a mounting boss (34). The pommel can be secured to a stock by inserting the mounting pin (36) into a mortised section (40) and pre-drilled hole (38) on the inner surface of one of the stocks (24).

8 Claims, 3 Drawing Figures

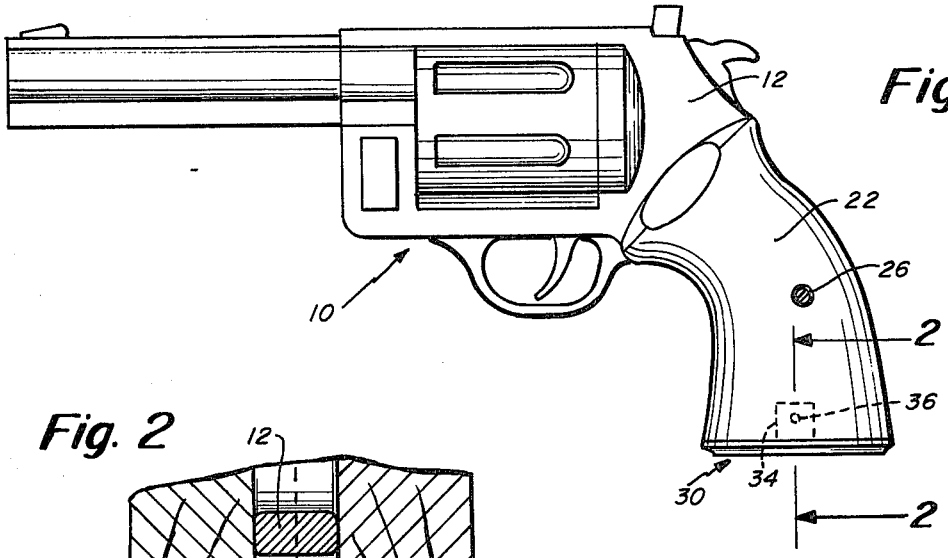
Fig. 1
Fig. 2
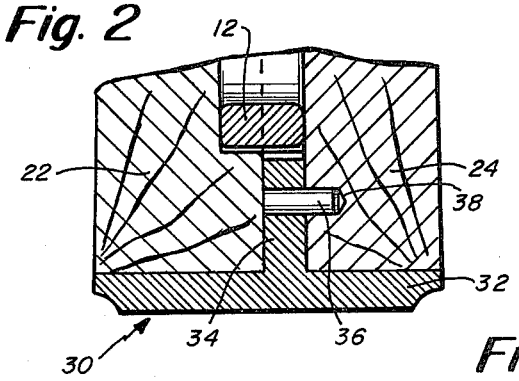
Fig. 3
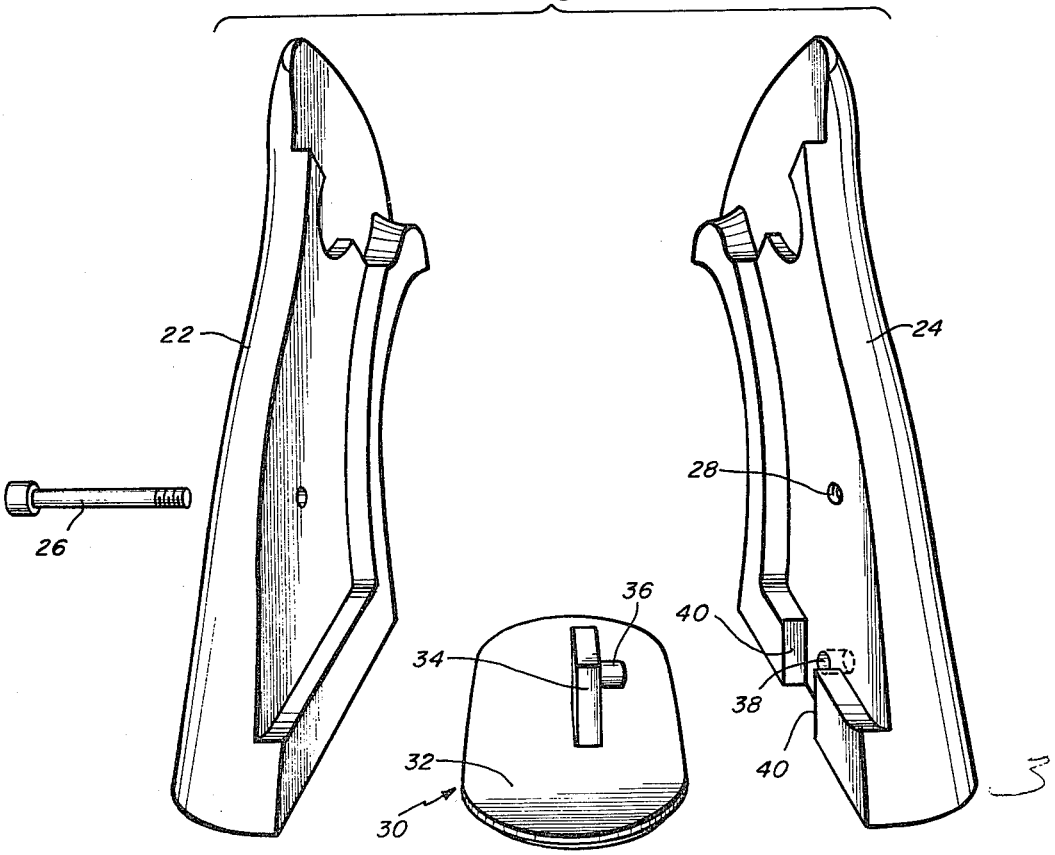

HANDGUN STOCK POMMEL

DESCRIPTION

1. Field of the Invention

This invention is in the field of firearms and more specifically relates to a pommel which can be mounted to the removeable stocks of a handgun.

2. Background Art

It has long been customary, perhaps more in the past than in the present, to provide a butt plate or pommel on the stocks of a handgun. Such pommels are typically made from metal and add to the aesthetic appeal of the stock as well as serving as some protection.

Heretofore, pommels have been mounted to handgun stocks or gun frame members by means of screws, through pins, or by adhesively bonding to them. For example, Carpenter et al., U.S. Pat. No. 2,292,351, disclose a butt plate which is mounted on the rear of a rifle stock by screws. At the front of the rifle stock, Carpenter et al. disclose a pommel mounted on what is known as the pistol grip. Although no discussion of how this pommel attaches to the pistol grip is given, it would appear that it is adhesively joined to or integral with the pistol grip. Other U.S. patents disclosing butt plates or pommels which are screwed to handgun stock are: U.S. Pat. Nos. 102,782; 3,384,988; and 3,852,904.

DISCLOSURE OF THE INVENTION

This invention relates to a novel and unique pommel which can be mounted to the stocks of a handgun. The pommel includes a pommel plate having one surface which can be plain, highly polished, or otherwise embelished with inlays, etc. On the opposite side of the pommel plate, a mounting boss extends transversely from the pommel plate. The mounting boss has means for securing the pommel to the handgun stocks, such as a mounting pin which can be inserted into a blind drilled hole on one or both of the handgun stocks.

The pommel described herein has many advantages over those heretofore known, among which are the following.

Initially, it should be noted that the visible portion of the pommel plate can have the appearance which has become well known and accepted for pommels. The unique mounting means does not interfere with or detract from this accepted appearance. Of course, other outer designs for the pommel plate are also acceptable.

No alteration to the handgun frame is required to provide the capability for mounting the pommel described herein. Furthermore, and very importantly, the pommel plate described herein does not require screws for mounting to the stocks. Screws or other such fastening means have a number of disadvantages including their unsightly appearance. Beyond this, they also interfere with the provision for other surface finishes or the mounting of emblems on the pommel face, engraving or the provision of inlays therein. Finally, provision of screws often has the deleterious effect of splitting the wooden stocks or making them vulnerable to splitting if the handgun is dropped or struck in a manner which provides a sharp impact to the stocks.

Despite the absence of screws or other such fastening means, the unique mounting arrangement provided on the pommel described herein does provide a very rigid and secure mounting to the handgun stocks. Despite the secure mounting, the pommel can be simply removed using conventional tools.

Despite all these advantages, the pommel plate described herein can be manufactured relatively inexpensively, and can also be mounted on a custom basis for persons desiring such a pommel on their handgun stocks.

BRIEF DESCRIPTION OF THE DRAWINGS

FIG. 1 is a side elevational view of a typical handgun having removeable stocks and a pommel according to this invention;

FIG. 2 is a sectional view along line 2—2 in FIG. 1; and,

FIG. 3 is a perspective view of disassembled removeable handgun stocks together with a pommel plate according to this invention illustrating how the various components interrelate.

BEST MODE OF CARRYING OUT THE INVENTION

This invention will now be described in more specific detail with regard to the Figures.

In the Figures, like numerals refer to like elements.

In FIG. 1, a revolver 10 is shown typical of many handguns. Revolver 10 includes a frame 12, usually formed from a metal such as steel and has various components extending therefrom.

Frame 12 extends downwardly to form a handle having stocks 22 and 24 on the respective sides of the handle. Stocks 22 and 24 are typically fastened to the frame handle by screw 26 which extends through stock 22, frame 12, and into tapped hole 28 located in stock 24.

Pommel 30 is located at the base of stocks 22 and 24. Typically, pommel 30 is fabricated entirely of brass or steel, or other such materials.

As can be seen clearly in FIG. 3, pommel 30 has a pommel plate 32 which is generally planar on its upper and lower surfaces, unless it is otherwise inlaid, etc., at its outer surface. Although shown with rounded corners, pommel plate 32 can be produced in any desired shape and is generally produced to conform as closely as possible to the butt surface and outline formed at the base of stocks 22 and 24 when they are joined. Pommel plate 32 is shown having a molded edge which has become one accepted configuration for such pommel plates. Pommel mounting boss 34 extends transversely upwardly from the inner surface of pommel plate 32. As shown in FIG. 3, pommel mounting boss 34 is located slightly off the central axis of pommel plate 32, although this is not necessary and boss 34 could be located anywhere on the inner surface of plate 32. Mounting pin 36 extends transversely from mounting boss 34 and is intended to be inserted within blind drilled hole 38 at the recessed inner face of mortised section 40 in stock 24 when the components are assembled. Other mounting means for securing the pommel plate to the removeable stocks 22 or 24 can extend from pommel mounting boss 34.

The assembled relationship of the various components can be seen most clearly in FIG. 2. Therein, it can be seen that the removeable wooden target stocks 22 and 24 are secured one to the other by screw 26 (not shown). Pommel 30 is in turn secured to stock 24 by mounting pin 36 which extends into blind drilled hole 38. Blind drilled hole 38 will have a size calculated to receive pin 36 and to retain it properly therein. Pin 36 can be pressed into hole 38 because mortised section 40 allows mounting boss 34 to be inserted therein. Pommel 30 is finally secured to stocks 22 and 24 by compressed entrapment between stocks 22 and 24 assembled in their normal and proper manner to handgun frame 12, such as by screw 26. This fit is very secure.

Although stocks 22 and 24 illustrated in the Figures are typical of target stocks for a revolver, the pommel described herein can be employed with other stocks for handguns.

INDUSTRIAL APPLICABILITY

This invention is useful in the provision of butt plates or pommels for handgun stocks.

EQUIVALENTS

Those skilled in the art will also recognize, or be able to determine using no more than routine experimentation, other equivalents to the specific embodiments described herein. Such equivalents are intended to be covered by the claims appended hereto.

I claim:

1. A pommel for mounting to stocks of a handgun, said pommel comprising a pommel plate having thereon a mounting boss extending from the inner face of said plate, said mounting boss having means for securing said pommel to said handgun stocks.

2. A pommel of claim 1 wherein said means for securing comprise a mounting member extending from said mounting boss.

3. A pommel of claim 2 wherein said handgun comprises a revolver.

4. A pommel of claim 3 wherein said revolver stocks are formed from wood.

5. A pommel of claim 4 wherein the outer surface of said pommel plate is generally planar.

6. A pommel of claim 5 wherein said pommel is fabricated from metal.

7. A pommel of claim 6 wherein said pommel is fabricated from brass.

8. A pommel of claims 6 or 7 wherein the edge of said pommel is molded.

* * * * *